US011404034B1

(12) United States Patent
Burns, Jr.

(10) Patent No.: US 11,404,034 B1
(45) Date of Patent: Aug. 2, 2022

(54) SYSTEM AND METHOD FOR AUTOMATIC DRUMMING

(71) Applicant: Michael Bryan Burns, Jr., St. James, NY (US)

(72) Inventor: Michael Bryan Burns, Jr., St. James, NY (US)

( * ) Notice: Subject to any disclaimer, the term of this patent is extended or adjusted under 35 U.S.C. 154(b) by 0 days.

(21) Appl. No.: 17/566,944

(22) Filed: Dec. 31, 2021

(51) Int. Cl.

| | |
|---|---|
| ***G10D 13/10*** | (2020.01) |
| ***G10D 13/12*** | (2020.01) |
| ***G10F 1/08*** | (2006.01) |
| ***G10H 1/00*** | (2006.01) |
| ***G10F 5/02*** | (2006.01) |

(52) U.S. Cl.
CPC ..... *G10D 13/26* (2020.02); *G10D 13/12* (2020.02); *G10F 1/08* (2013.01); *G10F 5/02* (2013.01); *G10H 1/0008* (2013.01); *G10H 1/0066* (2013.01); *G10H 2230/281* (2013.01)

(58) Field of Classification Search
CPC ..... G10D 13/26; G10D 13/12; G10F 1/08; G10F 5/02; G10H 1/0008; G10H 1/0066; G10H 2230/281
See application file for complete search history.

(56) References Cited

U.S. PATENT DOCUMENTS

| | | | | |
|---|---|---|---|---|
| 5,142,961 | A * | 9/1992 | Paroutaud | G10H 3/00 84/645 |
| 5,266,732 | A * | 11/1993 | Suzuki | G10F 1/10 84/464 R |
| 5,270,480 | A * | 12/1993 | Hikawa | G10H 1/0066 84/645 |
| 7,608,771 | B2 * | 10/2009 | Fournier | G10D 13/11 84/422.1 |
| 8,029,329 | B2 * | 10/2011 | Greenley | A63H 33/005 446/318 |
| 8,389,848 | B1 * | 3/2013 | Baker | G10H 1/348 84/746 |
| 10,366,683 | B2 * | 7/2019 | Iio | G10H 1/0008 |
| 10,600,395 | B2 * | 3/2020 | Bell | G09G 3/22 |
| 2008/0053292 | A1 * | 3/2008 | Fournier | G10D 13/11 84/422.1 |
| 2014/0053714 | A1 * | 2/2014 | Baker | G10H 1/348 84/746 |

FOREIGN PATENT DOCUMENTS

| | | | |
|---|---|---|---|
| JP | 2019028375 | A | 2/2019 |
| KR | 100663302 | B1 | 1/2007 |

* cited by examiner

*Primary Examiner* — Jeffrey Donels

(57) ABSTRACT

A system and method for automatic drumming. A MIDI decoder (1) receives MIDI serial data in real-time, decodes said MIDI serial data to obtain playing instructions, and signals at least one actuator (2) to strike at least one drum according to said decoded playing instructions. User inputs for selecting the MIDI channel and assigning MIDI notes to drums may be provided. The intensity of percussion may be controlled by the MIDI velocity and may be overridden by the user at the MIDI decoder. The at least one actuator may employ a solenoid and comprises features to mitigate latency between the MIDI serial data received and the drum hit. The at least one actuator may comprise a clamping or securement means enabling fast and convenient repositioning thereof. The at least one actuator may comprise means for substitution of a percussion implement, such as a drumstick, brush, or mallet.

16 Claims, 11 Drawing Sheets

2
15
15
27
28
29
31
35
36
37
38
44
2
22
23
25
26
27
29
31
35
39
50
52
53
54
55
56
2
22
23
25
27
28
29
31
35
36
37
38
39
41
42
43
44
50
51
56

SYSTEM AND METHOD FOR AUTOMATIC DRUMMING

BACKGROUND OF THE INVENTION

The present invention relates generally to the field of automatic percussion musical instruments. Specifically, the present invention relates to systems and methods for automatic drumming.

Heretofore, various inventions have been provided for automatically performing drums. The known automatic drumming systems typically comprise a controller that signals one or more drum-striking actuators. The known controllers typically comprise means for music data storage or means for connecting to a music data storage medium. Music data is generally instructions for performing music, including notes, intensity, timing, etc. The term intensity is consistent with the terms loudness, dynamic level, and volume. The music data performed by the known automatic drumming systems is typically composed prior to a performance and saved to a data storage medium. Furthermore, the music data is frequently arranged and modified to correct for actuator latency, the time delay between the signal from the controller to perform the note, and the striking of the drum. Often, music data composed for the known automatic drumming systems is system exclusive and can only be performed by the system for which it was composed. The controllers of the known automatic drumming systems execute saved music data and the music data and performance are immutable during the performance.

When music data is composed for an automatic drumming system prior to a performance, the music data can be composed according to the preferred intensity of each note of the composition. Furthermore, the notes of the music data can be assigned to various drums prior to the performance. The controllers of the known automatic drumming systems do not comprise means to assign or reassign notes to different drums on the fly. Moreover, the controllers of the known automatic drumming systems do not comprise means to change the intensity of the percussion on the fly. The known automatic drumming systems do not enable the performance of drums according to Musical Instrument Digital Interface (MIDI) serial data, transmitted as asynchronous bytes in real-time. Therefore, the known automatic drumming systems operate more similarly to a playback device than a dynamic instrument.

A further problem of the known automatic drum systems is that the drum-striking actuators thereof do not comprise means for fast and convenient repositioning. Moreover, the known drum-striking actuators lack means enabling fast and convenient substitution of the percussion implement, such as a mallet, drumstick, or brush.

BRIEF SUMMARY OF THE INVENTION

The present invention is generally related to a system and method for automatic drumming.

Any number of idiophonic instruments, any number of membranophonic percussion instruments, and any combination thereof shall be referred to herein as "drums", in the plural, and "drum", in the singular. Electronic drums shall be considered drums for these purposes. Moreover, any object of matter that is generally of physical similarity to a drum shall be considered a drum for these purposes. Furthermore, any object played or performed like an idiophonic or membranophonic percussion instrument, regardless of whether the object was originally intended to be an instrument, shall be considered a drum for these purposes. For example, the present invention can perform drums comprising kitchen pots and pans.

The present invention can perform the drums according to MIDI serial data, transmitted as asynchronous bytes, received in real-time, including MIDI serial data created in real-time by a local or remote composer on a keyboard, drum pad, music sequencer, PC, tablet, smartphone, smartwatch, or any other MIDI serial data generating or transmitting instrument or device. Thus, the present invention enables a dynamic performance of drums according to real-time music data. Moreover, the present invention can perform the drums according to MIDI serial playback of prerecorded or prearranged MIDI compositions. The MIDI serial data performed by the present invention need not be composed, modified, or arranged for an automatic drumming system.

The present invention generally relates to a system comprising one MIDI decoder and at least one drum-hitting actuator.

Musical Instrument Digital Interface (MIDI) communications protocol enables the transmission of 16 channels of musical event data in real-time. Each channel carries musical event messages that specify musical instructions such as a note's pitch, velocity (volume), vibrato, and panning (left-right orientation in a stereo field). Generally, a MIDI note-on type message turns on one particular note. The term note is consistent with the term pitch. Generally, there are 128 MIDI notes, numbered 0 to 127 (where Middle C is note number 60). The term decoder is generally used because MIDI messages of MIDI serial data are transmitted as asynchronous bytes and a MIDI decoder "decodes" or deciphers the MIDI message pitch, velocity, vibrato, and panning, etc. from the bytes in the MIDI stream, in real-time.

By means of example, but not of limitation, the present invention can assign one MIDI note to each actuator. One or more actuators can be assembled for use with each preferred drum so that each MIDI note can be assigned to a drum of the user's choosing. Assignment of MIDI notes to drums may also be referred to as mapping or note mapping, herein. A MIDI note-on type message further comprises velocity, a value from 0 to 127, typically indicating the intensity of the note to be played. The present invention can preferably control the intensity of a percussive strike on the drum, according to, or by a function comprising, the MIDI note-on velocity.

The function of the MIDI decoder of the present invention is generally to receive and decode MIDI serial data in real-time and signal at least one actuator to strike at least one drum in real-time. The MIDI decoder disclosed herein presents improvements over the various known computers, decoders, and controllers for signaling drum-hitting actuators. The preferred embodiment of the MIDI decoder disclosed herein can operate independently of a PC. It does not require means for music data storage. It can enable note mapping, independently of a computer (PC, smartphone, tablet, etc.). It can modify its output signals to control the drumming intensity. Furthermore, it can modify its output signals according to, or by a function comprising MIDI note velocity. It can enable the user to adjust pulse-width modulation (PWM) duty cycle, output signal duration (typically measured in milliseconds), or both, for all outputs concurrently, or a select output or outputs, on the fly. Moreover, it can be configured to handle MIDI serial data over USB, MIDI serial data over 5-pin DIN, or both. It can be a MIDI class-compliant USB device, a USB MIDI Host, or both. It can display MIDI data, PWM settings, output signal duration, and other user settings in real-time, such as on an LCD.

The inventive actuator disclosed herein presents improvements over the various known actuators for hitting drums. The preferred embodiment can enable automatic drumming to be performed with negligible latency. Moreover, it can enable control of the drumming intensity, typically effectuated by changes to the power and duration of the signal from the MIDI decoder. The actuator preferably comprises an electromagnetic solenoid. When the solenoid is energized by a signal from the MIDI decoder, the solenoid drives a mechanical linkage to strike a drum. Preferred embodiments of the drum-hitting actuator of the present invention comprise the following features: Fixed or adjustable bump stops, also called stops or bumpers, can limit the travel of the actuator linkage and enable the linkage to bounce back-and-forth between the bump stops for fast rhythms and drum rolls. A return spring can force the percussion implement away from the head of the drum, after a drum hit, to reposition the percussion implement and actuator linkage for a subsequent hit. Other and further features of the actuator disclosed herein shall be described hereinafter.

The actuators of the present invention further and preferably comprise features enabling fast and convenient repositioning of the actuators. Moreover, percussion implements, such as mallets, drumsticks, and brushes, can preferably be substituted, enabling fast and convenient reconfiguration of the actuator for different drums and according to user preference.

According to a first theoretical scenario exemplifying the benefit of the herein disclosed automatic drumming system, a keyboardist can perform a melody on a keyboard synthesizer. The audio output of the keyboard synthesizer can be routed to loudspeakers to voice the melody according to the sound of a trumpet. The melody can simultaneously be outputted from the keyboard synthesizer via MIDI 5-pin DIN to the herein disclosed automatic drumming system configured for performing a selection of drums. The result will be a performance of drums coincident with the notes of the trumpet melody voiced over the loudspeaker. Furthermore, the MIDI signal can be daisy-chained to subsequent MIDI devices, downstream of the MIDI decoder, using MIDI Through (also referred to as MIDI Thru), described in further detail hereinafter.

According to a second theoretical scenario exemplifying the benefit of the herein disclosed automatic drumming system, a member of a rock band can perform rock drums, during a live performance on stage, by tapping the pads of a drum sequencer application on a smartphone and routing the MIDI output from the smartphone to the herein disclosed automatic drumming system configured for performing the rock drum kit.

According to a third theoretical scenario exemplifying the benefit of the herein disclosed automatic drumming system, a music band can compose a MIDI arrangement for a song using a digital audio workstation (DAW) and listen to the playback of the arrangement on headphones, voicing the notes of the arrangement with virtual instruments (a type of software that acts as a sound module). Next, the same arrangement can be played by the DAW and the MIDI output routed via a USB cable to the herein disclosed automatic drumming system configured for performing a selection of drums. The MIDI composition need not be modified in any way. The band can position the actuators of the herein disclosed automatic drumming system for the performance of the applicable drums, with drum mounting hardware already on hand. The percussion implements of the actuators, such as mallets and drumsticks, can be substituted as needed according to the drums and sounds preferred. The resulting drum performance can be an acoustic equivalent to the virtual instrument playback heard on the headphones. The band can then play other instruments while the drums are automatically performed. This is especially valuable if a drummer is not available, an available drummer is not competent, or if an available and competent drummer lacks the time necessary to learn how to play a new song.

Thus has been generally conveyed some of the more important features and benefits of the invention to facilitate a more clear understanding of the description and the present invention's contribution to the art. Other and further objects of the invention, together with independent features and independent advantages appurtenant thereto, will become apparent to those skilled in the art upon review of the detailed description and drawings.

BRIEF DESCRIPTION OF THE SEVERAL VIEWS OF THE DRAWINGS

The present invention is illustrated by way of example and not limitation in the FIGS. of the accompanying drawings in which like references indicate similar elements.

DETAILED DESCRIPTION OF THE INVENTION

Figure 1:
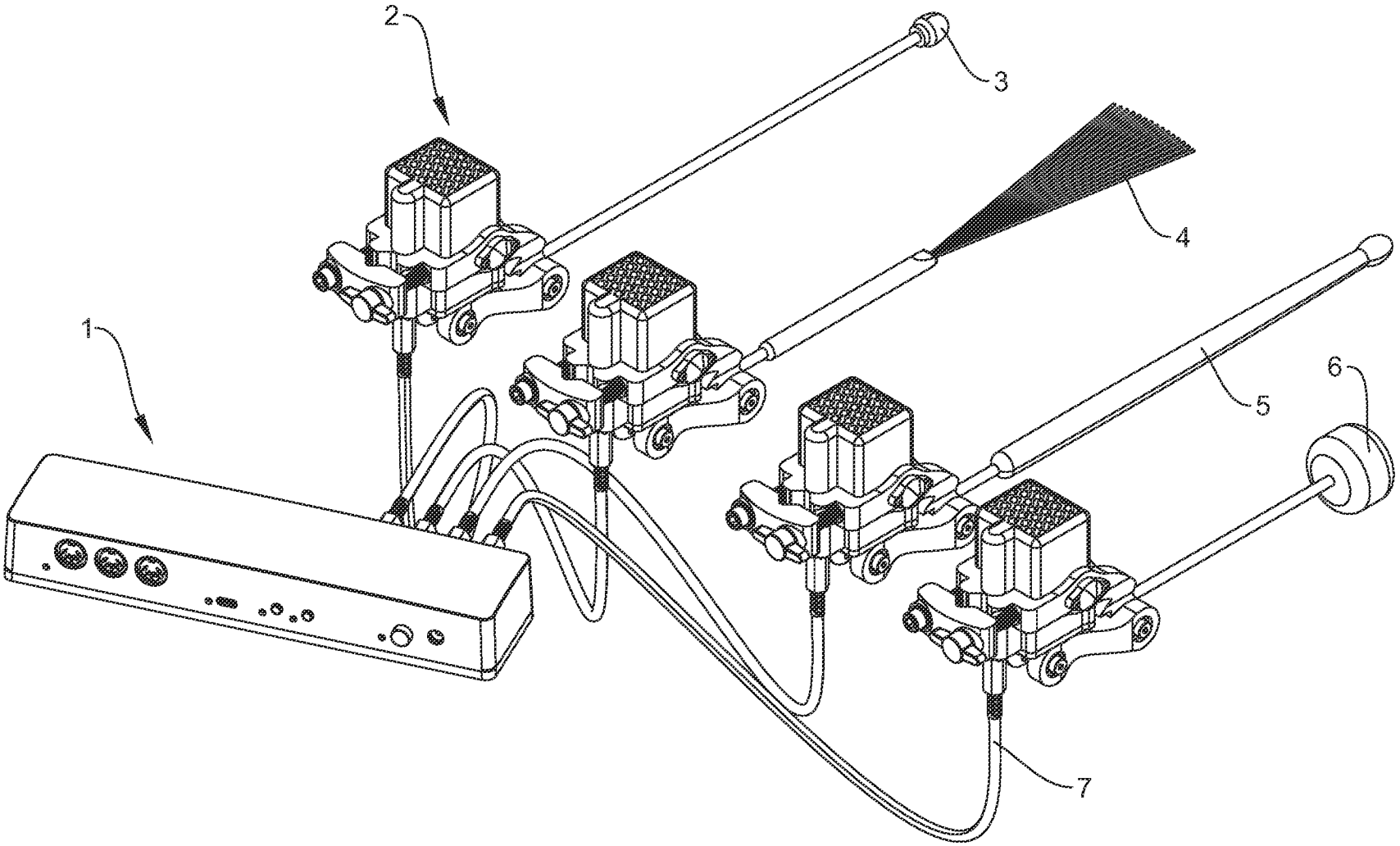
FIG. 1 is a perspective view of a midi decoder and a plurality of actuators.

FIG. 1 is a perspective view of one preferred embodiment of the present invention, shown apart from the drums or mounting accessories with which it is intended for use. Therein is one preferred embodiment of the MIDI decoder 1 and a plurality of the preferred embodiment of the actuators 2. The operating procedures of the MIDI decoder 1 are generally described by the flow chart representation of FIG. 17. Further illustrated are four examples of suitable percussion implements, namely a small, rigid mallet head 3, a brush 4, a drumstick 5, and a felt mallet 6. The percussion implements 3-6 shown are examples only and demonstrate the flexibility and customizability of the system. Any number and combination of percussion implements can be selected and attached to the actuators by means further described hereinafter.

Figure 2:
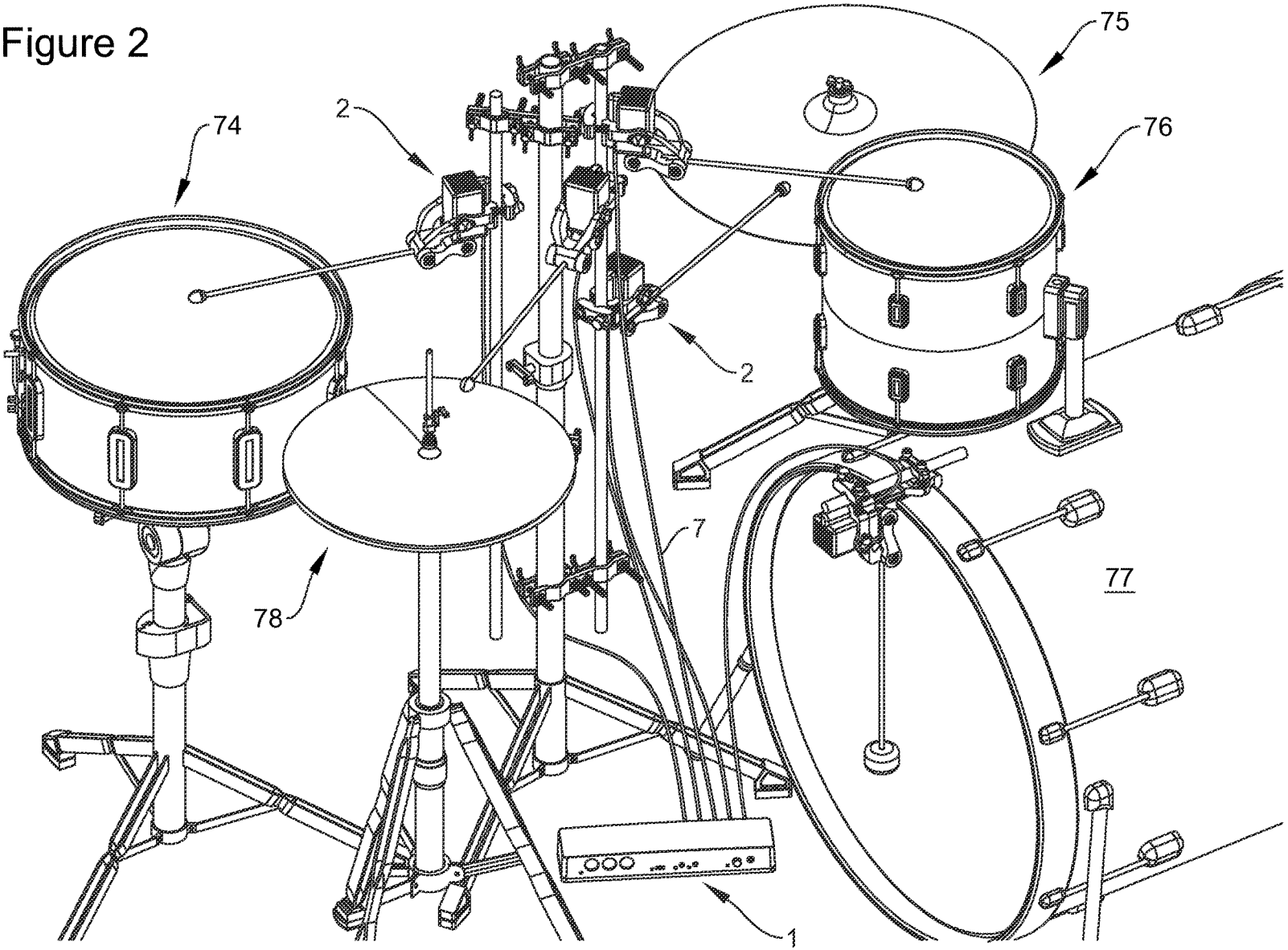
FIG. 2 is a perspective view of the MIDI decoder and actuators, shown in FIG. 1, assembled for use with a drum set, using hardware and accessories, such as drum clamps, which are, to drummers and percussionists, and to those skilled in the art, known to be common, familiar, and readily and commercially available.

FIG. 2 illustrates the preferred embodiment of the MIDI decoder 1 and a plurality of actuators 2, assembled to a typical drum set, using hardware and accessories, such as drum clamps, that are, to drummers and percussionists, and to those skilled in the art, known to be common, familiar, and readily and commercially available. Five electromechanical actuators 2 are depicted. A first is oriented to perform a snare drum 74, a second to perform a ride cymbal 75, a third to perform a tom (tom-tom) drum 76, a fifth to perform a bass drum 77, and a sixth to perform a hi-hat 78. The midi decoder 1 is depicted resting on the floor. A MIDI decoder power supply and MIDI cables are not shown. Each actuator 2 is connected to the MIDI decoder 1 by a separable cable 7. FIG. 2 depicts one example of one foreseeable arrangement of the invention and a plurality of drums, and it is not intended to be limiting.

Figures 3, 4:
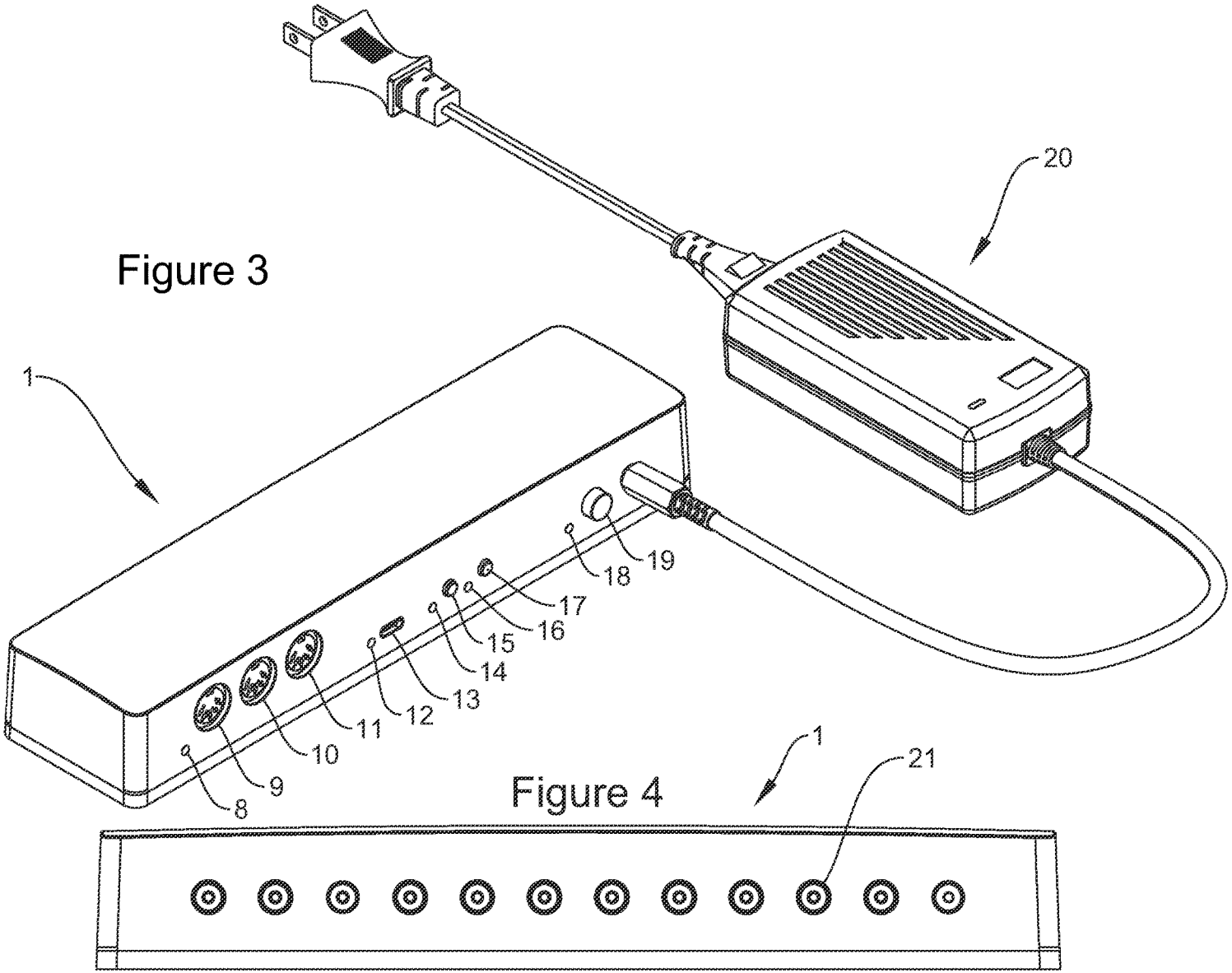
FIG. 3 is a perspective view of the MIDI decoder shown in FIG. 1. A power supply for the MIDI decoder is shown.
FIG. 4 is a rear view of the MIDI decoder shown in FIG. 1.

FIG. 3 further details the preferred embodiment of the MIDI decoder 1. A power supply 20 delivers power to the MIDI Decoder 1. The power supply 20 can be linear, switched, battery-based, or of other design. The power supply 20 preferably converts AC mains to DC and preferably outputs a voltage of 12V, 24V, or 48V DC. The power supply 20 can be separable from the decoder. Moreover, the power supply 20 can be external to the MIDI decoder 1 or housed within an electrical enclosure of the MIDI decoder 1. Power for the MIDI decoder 1 can alternatively be provided by a battery, lending greater portability. The MIDI decoder 1 preferably comprises a MIDI In (input) port 9 or ports and preferred embodiments employ both a 5-pin DIN female MIDI port and a USB port 13 for receipt of MIDI over USB. Other embodiments of the MIDI decoder may include ports or means for receipt of MIDI serial data over other wired technologies, such as Ethernet, or wireless technologies, such as radio frequency (RF). The MIDI decoder 1 preferably comprises a MIDI Out port 10 and a MIDI Thru port 11. MIDI Out ports generally send data generated by the device. MIDI Thru ports generally send a copy of the data received by a MIDI In port, so that it can be routed to additional devices. This may be called daisy-chaining. The preferred embodiment of the MIDI Decoder 1 transmits MIDI Thru by means of a hardware circuit between the MIDI In and MIDI Thru connectors. Alternatively, a second universal asynchronous receiver-transmitter (UART) can be used to re-transmit the bytes received by the MIDI In. The MIDI decoder 1 preferably comprises a power switch 19 to turn the decoder on and off. A power switch can, by means of example, but not of limitation, be a physical switch or latching button, optionally including a replaceable fuse, a soft switch that controls the flow of electrons indirectly using relays, MOSFETs, or SSR (solid-state relays), or any input hardware device, such as a button or touchscreen, for placing the decoder into a sleep or similar low power or power-saving mode.

As shown in FIG. 4, a rear view of the preferred embodiment of the MIDI Decoder 1, the MIDI decoder comprises a plurality of output ports 21. Output ports may alternatively be referred to as output channels, output lines, or simply outputs. By means of example, but not of limitation, the MIDI Decoder 1 (shown in FIGS. 1-4) comprises 12 outputs. Outputs can be wired directly to the actuators using soldered connections, wire crimps, or any other permanent connection means and can employ a strain relief. However, according to the preferred embodiment of the invention, illustrated in FIG. 4, the output ports 21 comprise female power connectors that mate with the male connectors on each end of the separable cables 7 (shown in FIGS. 1-2). The shape of the MIDI decoder 1 and the type, mode, and arrangement of the inputs and outputs is provided for example only and is not intended to be limiting.

The preferred embodiment of the MIDI decoder 1, shown in FIG. 3, comprises an LED 18 for indicating the power input state, where LED 18 generally illuminates while power is supplied. Another LED 8 is employed adjacent to the 5-pin DIN female MIDI In port 9 and illuminates when MIDI serial data is received via 5-pin DIN. Yet another LED 12 is placed adjacent to the USB port 12 and illuminates when MIDI serial data is received over USB. Yet another LED 14 is employed adjacent to the channel button 15. The channel button LED 14 illuminates when the channel button 15 is depressed. Yet another LED 16 is shown adjacent to the map button 17. The map button LED 16 illuminates when the map button 17 is depressed. LEDs indicating a signal on condition may also be employed for any of the output ports 21 (see FIG. 4), but are not illustrated. All LEDs can be used with a light pipe or pipes for aesthetic purposes, for resistance to ingress of dust or other matter, or for both purposes. Thus has been generally described the configuration of LEDs for the preferred embodiment of the MIDI decoder 1. Other embodiments can provide alternative LED configurations, or omit LEDs.

The preferred embodiment of the MIDI decoder 1, shown in FIG. 3, comprises one or more input hardware devices, such as buttons, knobs, sliders, and touchscreens, enabling the user to select or modify the MIDI decoder operating parameters. The preferred embodiment of the MIDI decoder 1 comprises an input button 15 for MIDI channel selection. The MIDI channel select button 15 can be depressed (step 58 of FIG. 17) to increase the MIDI channel by one (step 59 of FIG. 17). Other input hardware devices for changing the MIDI channel, such as an encoder, slider, or touchscreen can enable the same functionality and are also contemplated. Alternative embodiments of the MIDI decoder may omit the MIDI channel selection means entirely. Another button 17 can be provided for mapping MIDI notes to output ports. After the MIDI note mapping button 17 is depressed (step 60 of FIG. 17), the MIDI decoder 1 stores the channel of the first MIDI note-on type message received and sets this channel as the MIDI decoder 1 operating channel (step 61 of FIG. 17). Moreover, the MIDI note of the first MIDI note-on message received after button 17 is depressed can be assigned to a first output 21. The note of the second MIDI note-on message received after button 17 is depressed can be assigned to a second output 21, and so forth until the preferred number of outputs are assigned. This activity, which may be called mapping or note mapping, during which the MIDI decoder outputs 21 are assigned to MIDI notes, is generally consistent with step 61 of the flowchart presented in FIG. 17. Other means for the user to assign MIDI notes to outputs, such as manually, via touchscreen, are also contemplated. Another embodiment of the MIDI decoder can include one or more output means for real-time display of the received MIDI serial data, such as channel, note, and velocity. The display of operating parameters or user-adjustable settings, such as PWM duty cycle or signal output duration is also contemplated. By means of example, but not of limitation, a display device can be a liquid crystal display (LCD) or thin-film transistor (TFT) display.

The MIDI decoder 1 (shown in FIGS. 1-4) preferably comprises a microcontroller unit (MCU) that, among other things, can decode received MIDI serial data and generate power signals. One embodiment of the MIDI decoder 1 can comprise an MCU with at least one onboard universal asynchronous receiver-transmitter (UART) for this purpose. According to this embodiment, a USB to UART bridge converter can be employed to enable the receipt of MIDI over USB. The USB to UART bridge converter can be embodied within the decoder housing, for example, placed on a printed circuit board with the MCU. Alternatively, an external converter device can be embodied between the MIDI decoder 1 and the MIDI USB transmitting device. Another embodiment of the MIDI decoder employs a USB MCU. The preferred embodiment of the MIDI decoder 1 is a MIDI class-compliant USB device and a USB MIDI Host.

Figure 17:
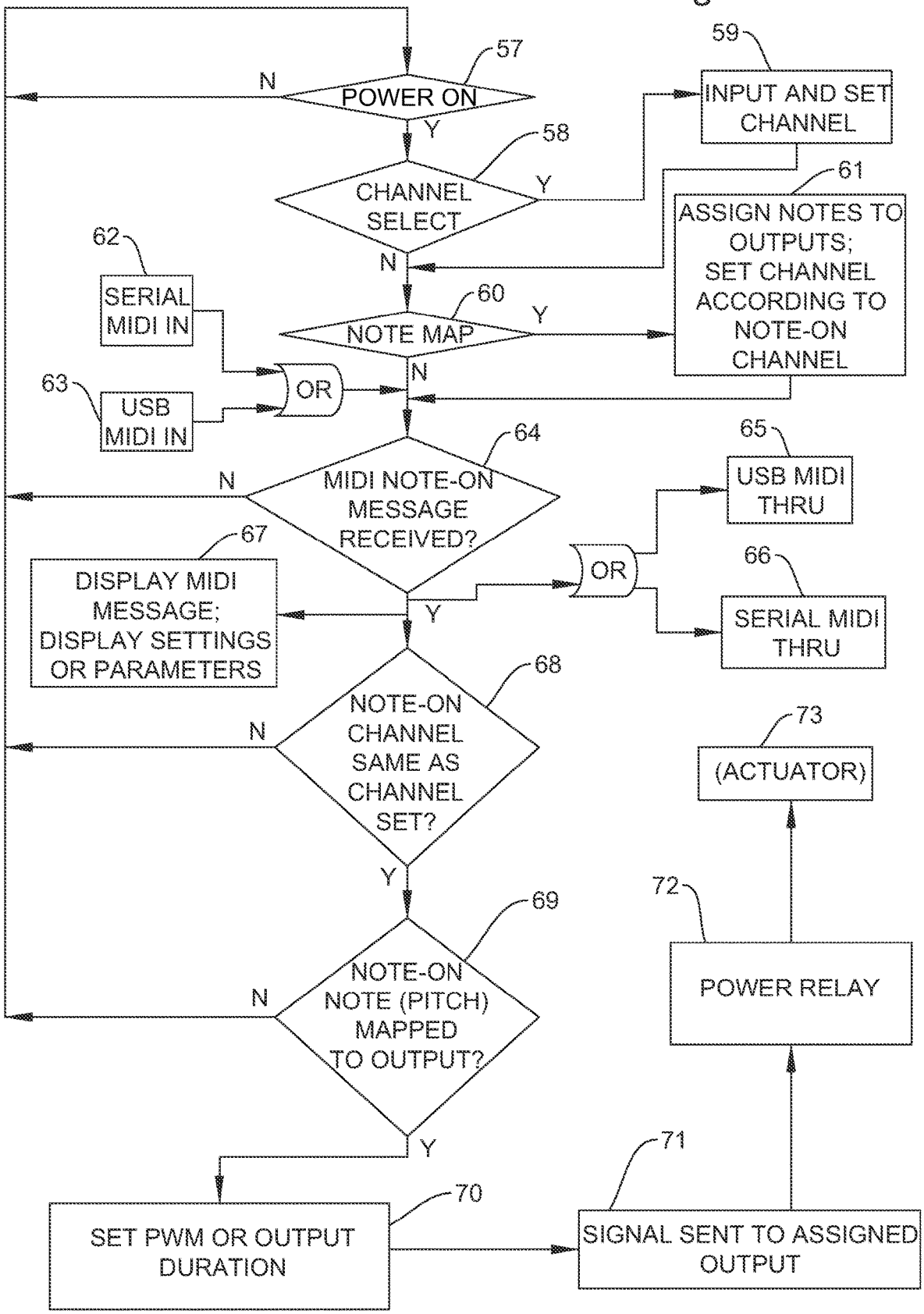
FIG. 17 is a flow chart representation of the processes generally carried out by the MIDI decoder shown in FIG. 1.

According to the flowchart illustrated in FIG. 17, after the user has set the MIDI operating channel (steps 58-59), and assigned MIDI notes to each output port (steps 60-61), the MIDI decoder 1 (shown in FIGS. 1-4) typically remains in standby until a MIDI note-on message is received via 5-pin DIN female MIDI In port (step 62) or USB port (step 63). When a MIDI note-on message is received, the MCU decodes and stores the note, channel, and velocity of the message. If the MIDI note-on message channel matches the channel set (step 68), and the note is confirmed to be mapped to an output (step 69), an output signal is generated (steps 70-71). The output can be a simple digital output, where the signal-on state corresponds to voltage high and the signal-off state corresponds to zero volts. According to step 70, the preferred decoder MCU and output configuration can control the output power using PWM. Furthermore, the PWM duty cycle can preferably be scaled according to, or by a function comprising, MIDI note-on message velocity. Similarly, the preferred decoder output configuration can adjust the output duration according to, or by a function comprising, MIDI note-on message velocity. Output duration refers to the duration of the output signal to the actuator, typically measured in milliseconds. Yet another embodiment of the MIDI decoder, not shown, comprises one or more input hardware devices, such as buttons, knobs, sliders, or touch-screens, or any combination thereof, enabling the user to manually adjust the PWM duty cycle, output signal duration, or both, either for all outputs 21 concurrently, or for a select output or outputs. Adjustment of PWM duty cycle and output signal duration can preferably be performed on the fly. Thusly, the intensity of drumming can be controlled by the MIDI data and can be overridden at the controller if the user prefers greater or lesser intensity than was originally composed.

According to the flowchart illustrated in FIG. 17, after the MCU generates the output signal (steps 70-71), the preferred embodiment of the MIDI Decoder employs a power switching circuit to magnify the power of the output, consistent with step 72. Higher output power is generally consistent with more powerful and therefore faster and louder actuators. According to the preferred embodiment, the MCU output signal applies voltage to the gate of a field-effect transistor (FET) (step 72). The FET sends a high power signal to the assigned output port 21. Other contemplated configurations of the high power switching circuit may comprise one or more MOSFET drivers, transistors, including IGBTs and BJTs, relays, solid-state relays, or other power switching devices of similar function, in lieu of, or in addition to FETs.

Figure 12:
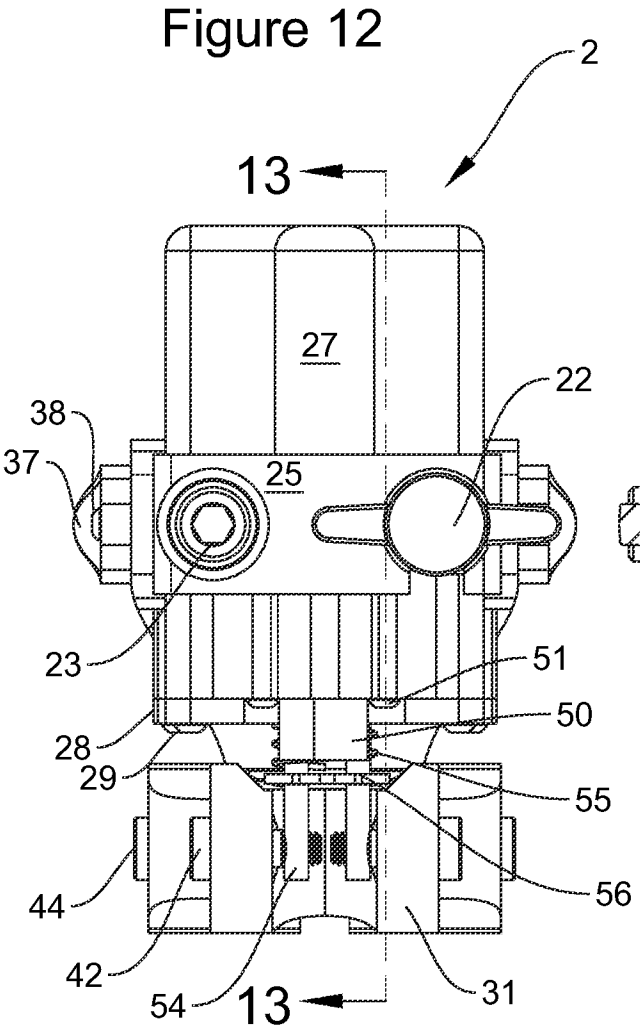
FIG. 12 is a rear view of one actuator shown in FIG. 1.

One electromechanical actuator 2, according to one embodiment of the present invention, is illustrated in FIGS. 1-2, 5-16. A rigid mallet head 36 (shown in FIGS. 5-6, 8-10, 14, 16) represents all percussion implements 3-6 (shown in FIG. 1). It is referred to hereinafter simply as the percussion implement. Except for components 22, 23, and 25, the illustrated embodiment of the electromechanical actuator 2 maintains left-right symmetry according to the front and rear views in FIGS. 6, 12, and 14. Reference characters in the drawings may be omitted if they are considered redundant due to obvious and apparent left-right symmetry.

Figure 5:
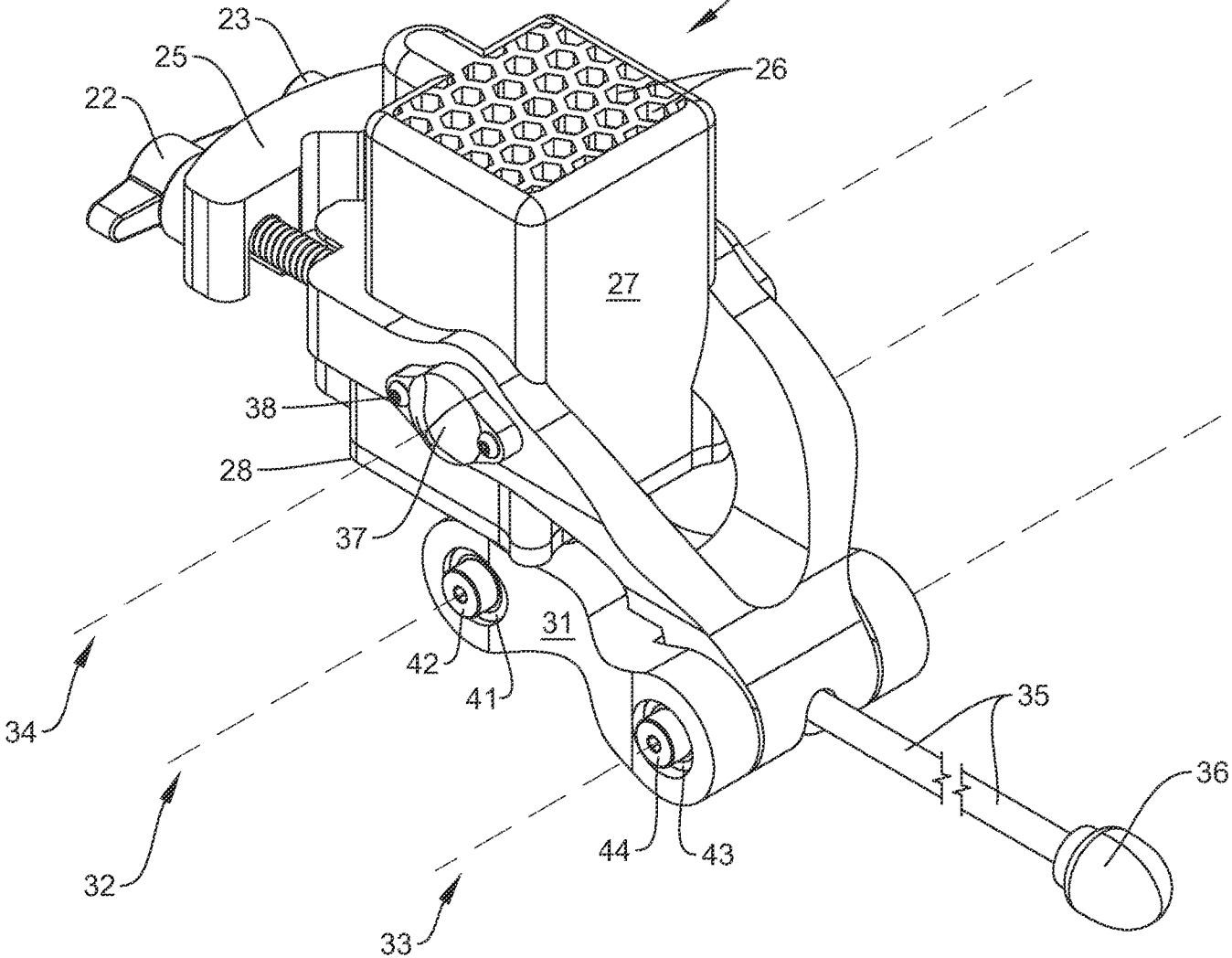
FIG. 5 is a perspective view of one actuator shown in FIG. 1.
Figure 6:
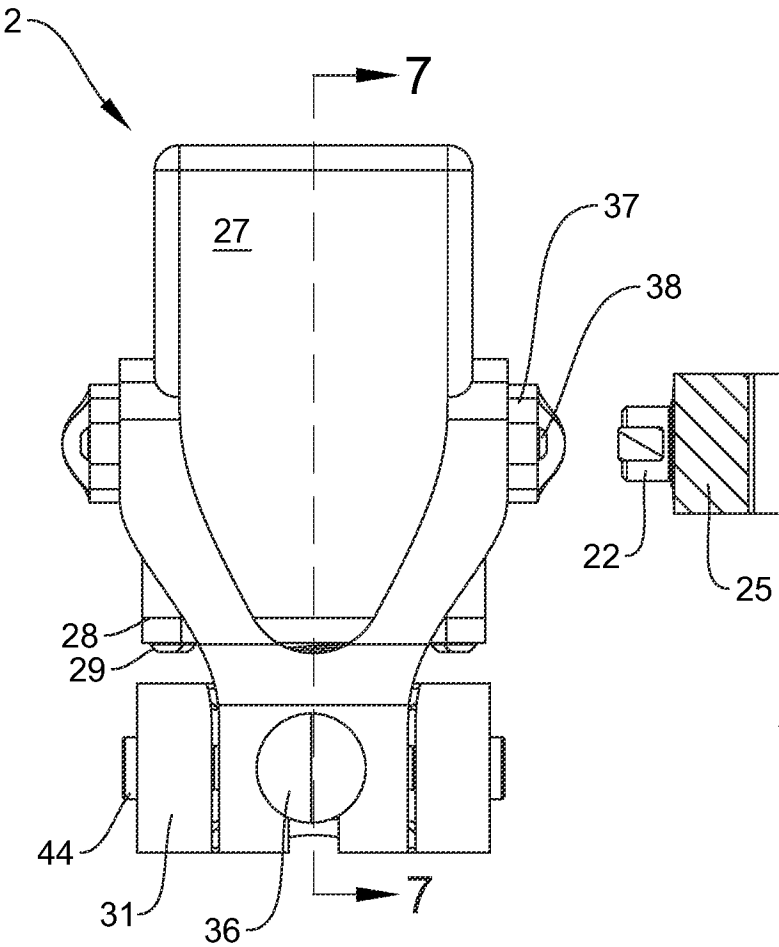
FIG. 6 is a front view of one actuator shown in FIG. 1.
Figure 8:
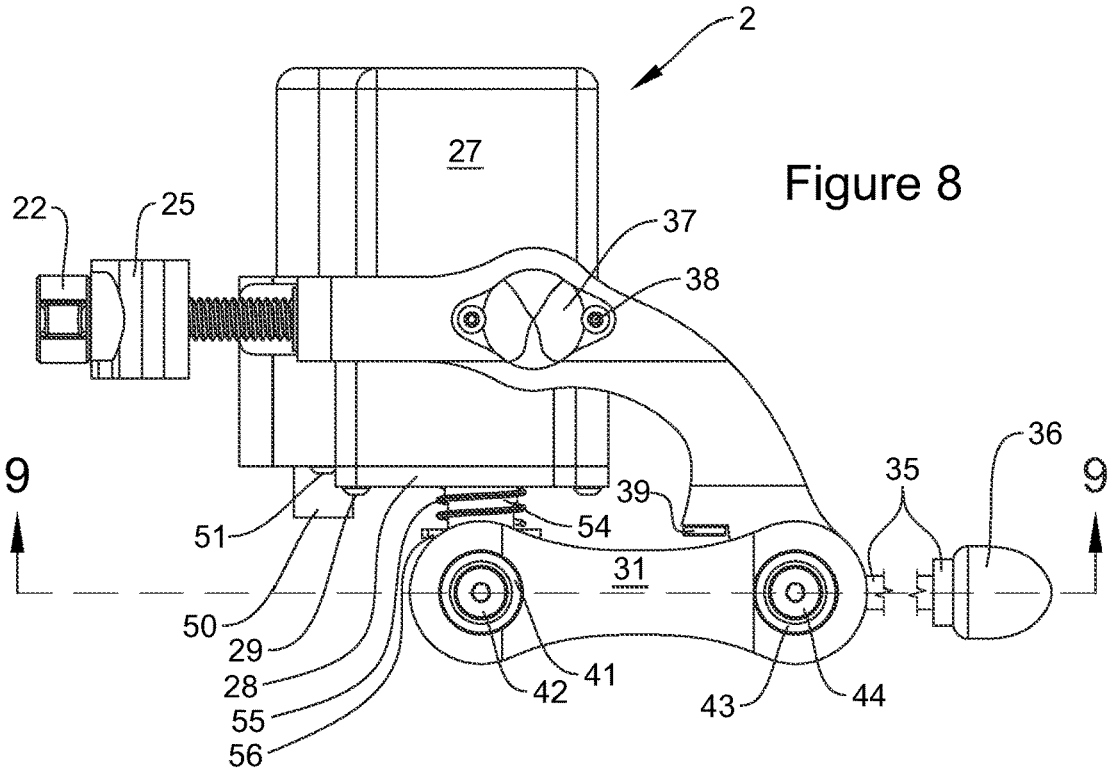
FIG. 8 is a side view of one actuator shown in FIG. 1.

FIG. 5 illustrates a perspective view of the actuator 2 (shown in FIGS. 1-2, 5-16), according to one preferred embodiment of the present invention. The actuator body 27 and clamp body 25 can be rigidly fixed during the operation of the actuator 2 by the tightening of the clamp wing nut 22 and clamp screw 23, and the resultant tightening of the clamp body about a solid body, not shown, such as a knurled rod. Bodies to which the actuator 2 can be clamped are often available on or near drum sets or assemblies of percussion instruments and are commonly embodied by drum stands, cymbal rods, mounting arms, L-rods, claw hook clamps, multi-clamp assemblies, cowbell and microphone mounting hardware, and other devices. Furthermore, a myriad of commercial components for fixing drums, accessories, and other devices are readily available for the same purposes. A washer 24 (shown in FIG. 11) can be employed between the clamp wing nut 22 and clamp body 25 and between the clamp screw 23 and the clamp body 25. Thus has been generally described the clamping configuration for the preferred embodiment of the actuator 2. Other clamps and mounting configurations, such as hose clamps, band clamps, spring clamps, C-clamps, and set-screw type clamps, can also be used and are also contemplated. Furthermore, means other than clamps for fixing the actuator to a support body, such as adhesive, zip-ties, direct screw or bolt mounting, welding, and magnets are contemplated.

Referring to FIG. 5, within the preferred embodiment of the actuator 2, the actuator body 27 houses a pull-type electromagnetic solenoid. When energized by an electrical signal from the MIDI decoder 1, the electromagnetic solenoid coil draws the solenoid plunger 54 (shown in FIGS. 7-10, 12-13, 15) into the solenoid coil and housing 52 (shown in FIGS. 7, 11, 13, 15). The solenoid plunger 54 is linked to the mallet assembly body 31 (shown in FIGS. 5-10, 12-17) by means of a rotatable joint about a first axis 32 (shown in FIG. 5). The preferred rotatable joint is a ball bearing assisted cylindrical joint. A ball bearing may reduce friction between rotating members and may increase the speed of the linkage. Furthermore, ball bearings may reduce undesirable noise from the moving parts of the actuator linkage. A cylindrical joint is employed for preferred embodiments, as opposed to a revolute joint, because it enables an additional degree of translational freedom in the axial direction. Freedom to translate in the axial direction enables the linkage to self-adjust in the axial direction and correct for any unintentional misalignment, rubbing, or interference caused by minor manufacturing defects, out-of-square conditions, or otherwise. The joints about a second and third axes, 33 and 34 respectively, employ the same general design, shape, arrangement, and ball bearing assisted cylindrical joint type.

When the solenoid plunger 54 (shown in FIGS. 7-10, 12-13, 15) is retracted, the rotatable joint between the solenoid plunger 54 and the mallet assembly body 31 (shown in FIGS. 5-10, 12-17), about the first axis of rotation 32 (shown in FIG. 5) is moved towards the solenoid coil and housing 52 (shown in FIGS. 7, 11, 13, 15). Consequently, the mallet assembly body 31 is rotated about the second axis 33 (shown in FIG. 5). Following a seesaw motion, the mallet arm 35 (shown in FIGS. 5, 7-10, 13-16) and percussion implement 36 (shown in FIGS. 5-6, 8-10, 14, 16), travel an arc centered about the second axis of rotation 33, opposite the plunger 54, striking the drum.

Immediately before, during, or immediately after the drum hit, the solenoid 52 is preferably de-energized, enabling the percussion implement 36 to bounce off of the drum. To accelerate the return stroke of the actuator linkage, a return spring 55 (shown in FIGS. 7-8, 10, 12-13, 15) is preferably employed. By means of example, but not of limitation, the return spring 55 is a compression spring, seated against the solenoid coil and housing 52 (shown in FIGS. 7, 11, 13, 15) and providing a force against a retaining ring 56 (shown in FIGS. 7-10, 12-13, 15) on the solenoid plunger 54. Other spring types may also be suitable to drive the return stroke of the actuator. Torsion springs, leaf springs, and elastomeric bands are among those contemplated.

Figure 7:
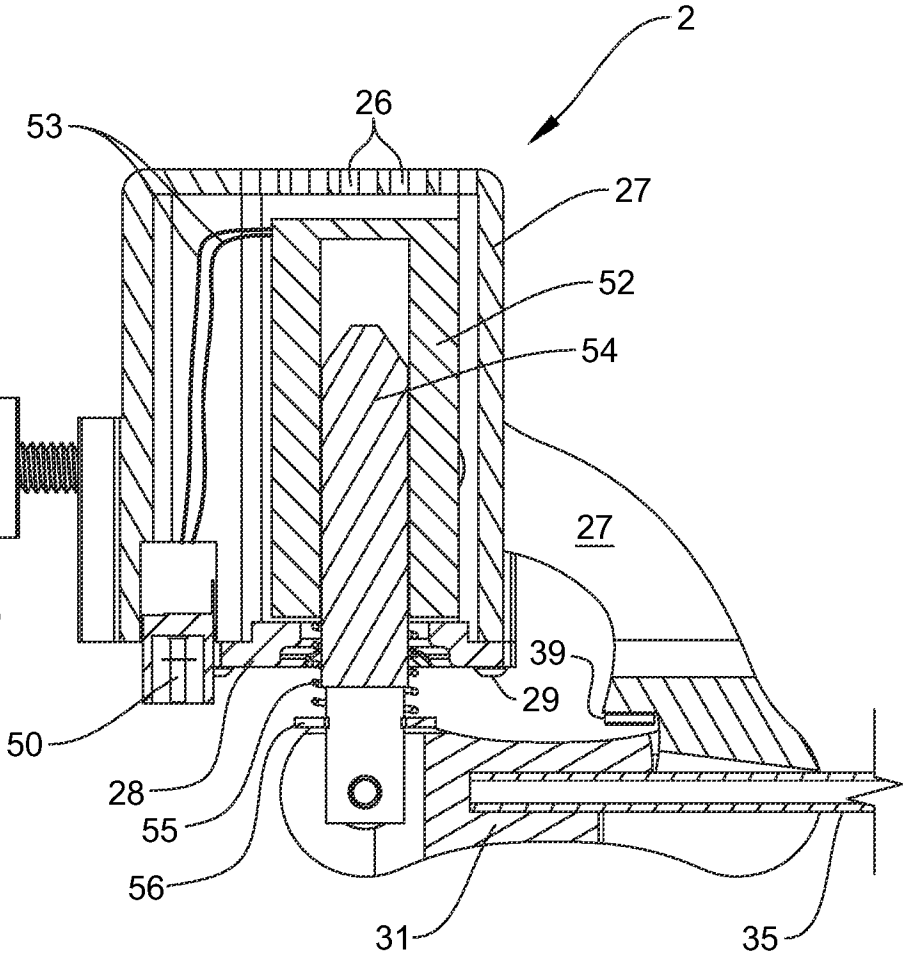
FIG. 7 is a section view of one actuator shown in FIG. 1.
Figure 9:
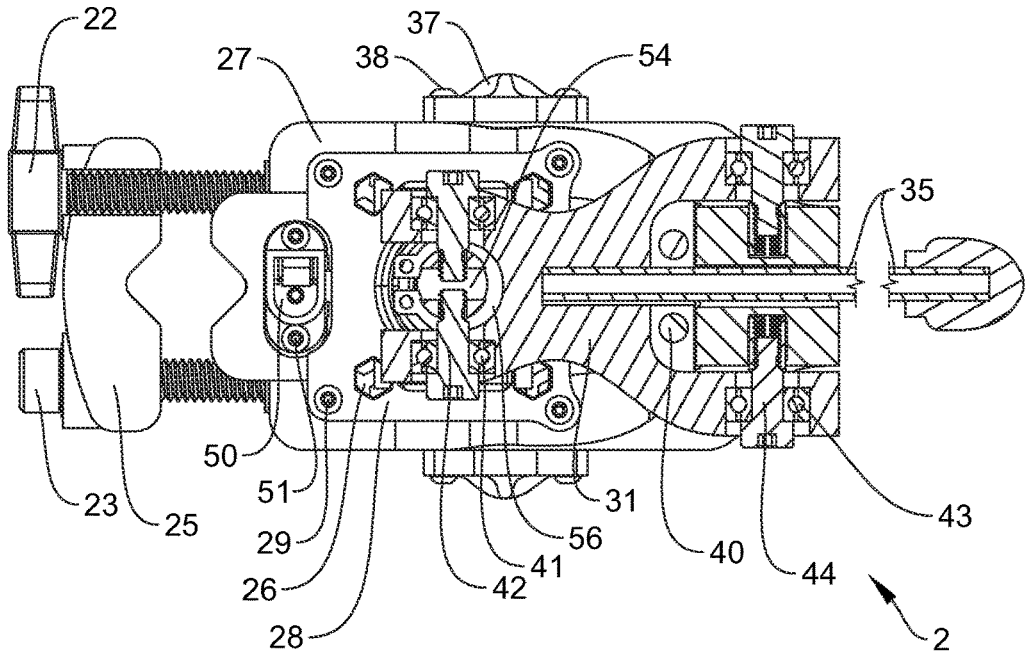
FIG. 9 is a section view of one actuator shown in FIG. 1.
Figure 13:
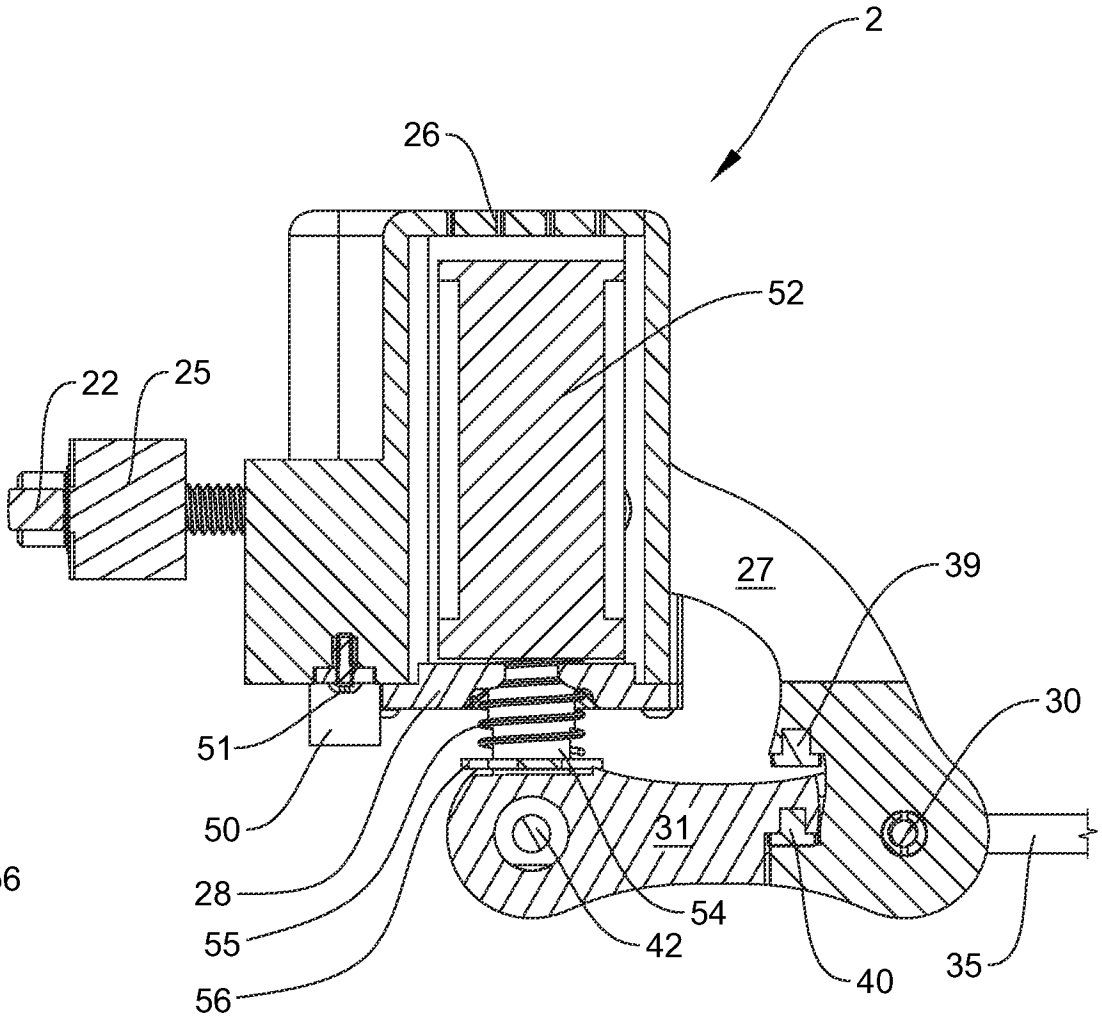
FIG. 13 is a section view of one actuator shown in FIG. 1.
Figures 14, 15, 16:
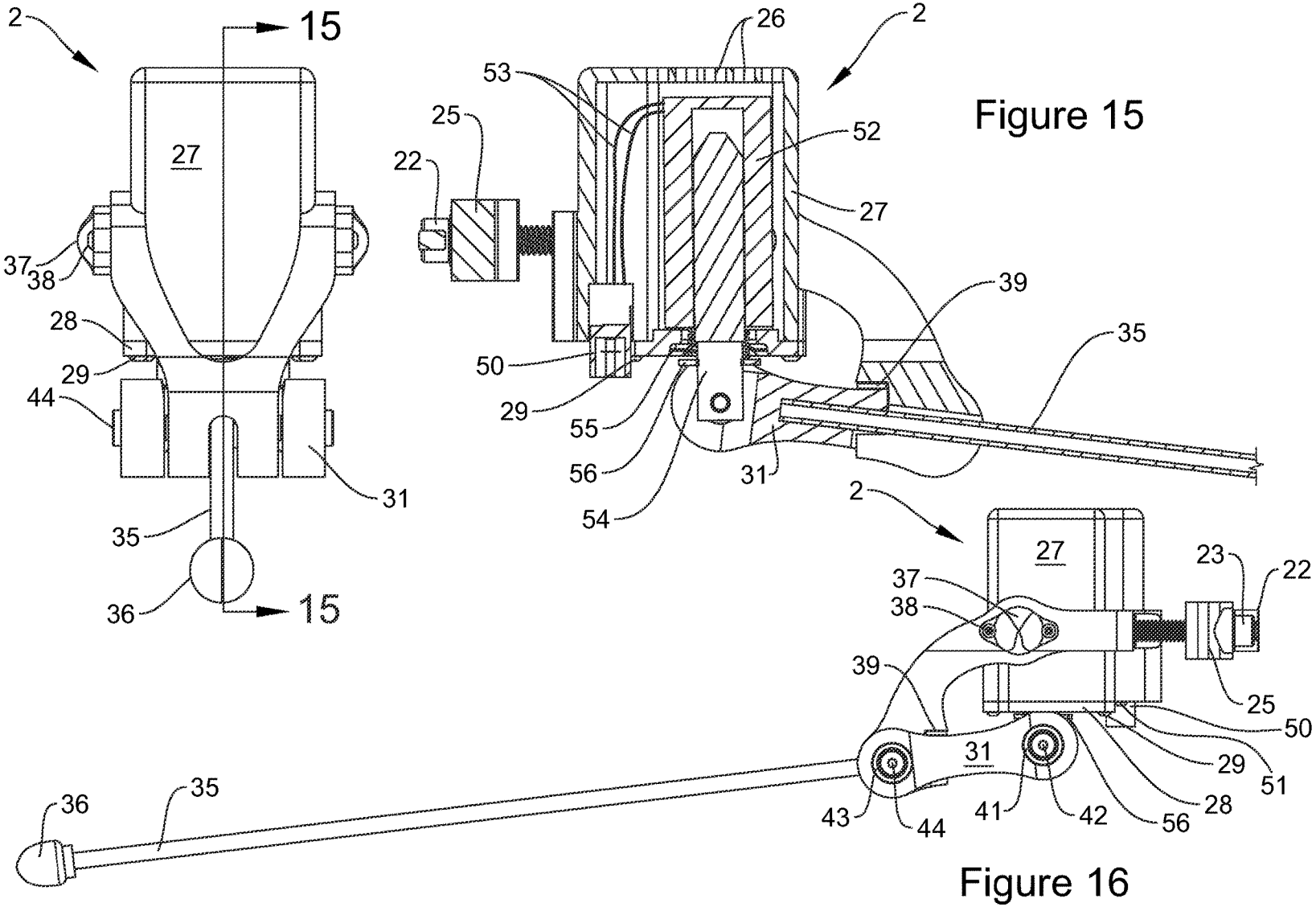
FIG. 14 is a front view of one actuator shown in FIG. 1, in an actuated position.
FIG. 15 is a section view of one actuator shown in FIG. 1, in an actuated position.
FIG. 16 is a side view of one actuator shown in FIG. 1, in an actuated position.

The mallet arm 35 (shown in FIGS. 5, 7-10, 13-16) can comprise a hollow core as depicted in the section views of FIGS. 7, 9, and 15. Alternatively, it can comprise a solid core. Furthermore, it can maintain stiffness, shape, and distribution of weight consistent with the preferred percussion timbre and intensity. According to the preferred embodiment of the actuator 2, the mallet arm 35 can be attached to the mallet assembly body 31 (shown in FIGS. 5-10, 12-17) by a clearance, interference, or transition fit. Similarly, percussion implements (see examples: small, rigid mallet head 3, brush 4, drumstick 5, and felt mallet 6 shown in FIG. 1) can be attached to the mallet arm 35 by a clearance, interference, or transition fit. Other securement means are also contemplated, such as adhesives, magnets, set screws, threaded joints, and push-fit type connections with integral self-locking retaining rings. Alternatively, the mallet assembly body 31 and mallet arm 35 can be a single, combined body. Furthermore, the mallet assembly body 31, mallet arm 35, and percussion implement 36 can be a single, combined body. Interference fits between the mallet assembly body 31, mallet arm 35, and percussion implement 36 are preferred because they can enable fast and tool-free removal and replacement of the percussion implement 36, and thereby fast and convenient customizability of the system according to the user's preferences.

A solenoid is a linear actuator. The solenoid plunger 54 (shown in FIGS. 7-10, 12-13, 15) is constrained to a single, translational degree of freedom into and out of the solenoid coil and housing 52 (shown in FIGS. 7, 11, 13, 15). When the plunger 54 is linked to the mallet assembly body 31 (shown in FIGS. 5-10, 12-17), the joint about the first axis 32 follows an arc about the second axis 33. Consequently, when the solenoid 52 is energized and the plunger 54 is retracted, the plunger undergoes translational and rotational motion. To facilitate the movement of the joint about the first axis 32 along an arc centered about the second axis 33, the solenoid coil and housing 52 maintain a rotational degree of freedom about the third axis of rotation 34. The joint about the third axis of rotation 34 enables the solenoid coil, housing, and plunger to rotate and align with the joint about the first axis 32 as that joint about the first axis 32 travels an arch about the second axis 33.

Preferred embodiments of the electromechanical actuator 2 (shown in FIGS. 1-2, 5-16) maintain cylindrical, ball bearing assisted joint types about the first 32, second 33, and third 34 axes of rotation (see FIG. 5). The joints about the first 32, second 33, and third 34 axes of rotation can alternatively comprise one or more pins, peened shafts, bushings, plain bearings, shaft collars, shaft retainers, or ball bearings. Furthermore, any alternative rotatable joint type, hardware, or mechanism about the first 32, second 33, and third 34 axes of rotation shall constitute alternative embodiments of the invention claimed. Furthermore, thread locking compound is generally preferred for threaded joints about the first 32, second 33, and third 34 axes of rotation.

The preferred ball bearing assisted cylindrical joints about the first 32, second 33, and third 34 axes of rotation (see FIG. 5) comprise ball bearings and shoulder screws. For the joint about the first axis of rotation 32, the shoulder screws 42 (shown in FIGS. 5, 8-10, 12-13, 16) are threaded securely into the solenoid plunger 54 (shown in FIGS. 7-10, 12-13, 15). These shoulder screws 42 compose axles upon which the inner races of the first axis ball bearings 41 (shown in FIGS. 5, 8-10, 16) ride. The outer races of the first axis ball bearings 41 are rigidly fixed within bearing housings 47 (shown in FIG. 10), integral features of the mallet assembly body 31 (shown in FIGS. 5-10, 12-17).

For the joint about the second axis of rotation 33 (see FIG. 5), shoulder screws 44 (shown in FIGS. 5-6, 8-10, 12, 14, 16) are threaded securely into the actuator body and housing 27 (see FIGS. 5-16). These shoulder screws 44 compose axles upon which the inner races of the second axis ball bearings 43 (shown in FIGS. 5, 8-10, 16) ride. The outer races of the second axis ball bearings 43 are rigidly fixed within bearing housings 48 (shown in FIG. 10), integral features of the mallet assembly body 31 (shown in FIGS. 5-10, 12-17).

For the joint about the third axis of rotation 34 (see FIG. 5), shoulder screws 46 (shown in FIG. 11) are threaded securely into the solenoid housing 52 (shown in FIGS. 7, 11, 13, 15). The shoulder screws 46 compose axles upon which the inner races of the third axis ball bearings 45 (shown in FIG. 11) ride. The outer races of the third axis ball bearings 45 are rigidly fixed within bearing housings 49 (shown in FIG. 11), integral features of the actuator body and housing 27 (see FIGS. 5-16).

The preferred embodiment of the actuator body and housing 27 (see FIGS. 5-16) is molded of polymeric material and preferably comprises heat pressed, push-fit, integrally injection molded, or other threaded inserts at threaded connections. For example, shoulder screws 44 (shown in FIGS. 5-6, 8-10, 12, 14, 16) may be threaded into the actuator body, housing 27 (see FIGS. 5-16) with the aid of threaded inserts 30 (shown in FIGS. 10-11, 13). Self-tapping screws and heat pressed, push-fit, integrally injection molded, or other stud inserts, are suitable alternatives to the shoulder screws 42 (shown in FIGS. 5, 7, 10, 12-13, 15-16), 44 (shown in FIGS. 5-6, 8-10, 12, 14, 16), 46 (shown in FIG. 11). The actuator body and housing 27 may generally be constructed of any rigid material, and for certain materials, such as aluminum, tapped threads may be preferred instead of threaded inserts.

The stroke of a typical pull-type solenoid is inversely proportional to the pull force. Stroke is defined as the displacement or translation of the plunger with respect to the coil and base, bottom, or housing of the solenoid. A stroke of zero coincides with the fully actuated position, occurring after the electromagnetically induced plunger translation. The preferred embodiment of the actuator 2 (shown in FIGS. 1-2, 5-16) limits the stroke of the solenoid plunger, the travel of the attached mechanical linkage, or both, thusly constraining the solenoid operation to ranges of generally reduced stroke and high pull force. This increases the acceleration of the plunger and attached linkage and yields a faster and harder strike on the drum. A harder strike enables a louder percussive sound. Furthermore, a faster strike mitigates latency, the time delay between the signal from the decoder to perform the note and the striking of the drum. Moreover, a faster strike enables the performance of consecutive notes at reduced intervals, which enables the performance of faster rhythms.

Figure 10:
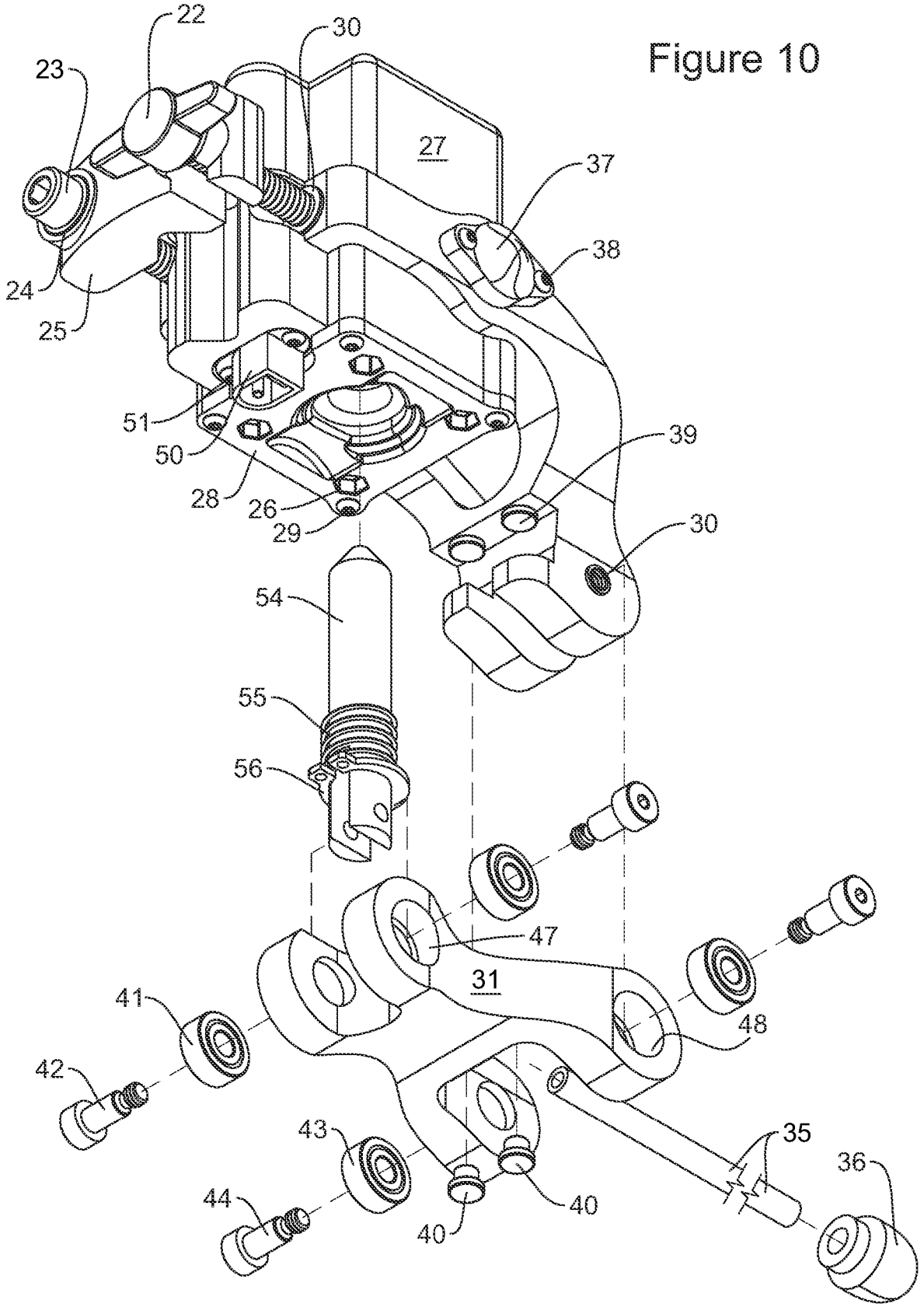
FIG. 10 is a partially exploded view of one actuator shown in FIG. 1.
Figure 11:
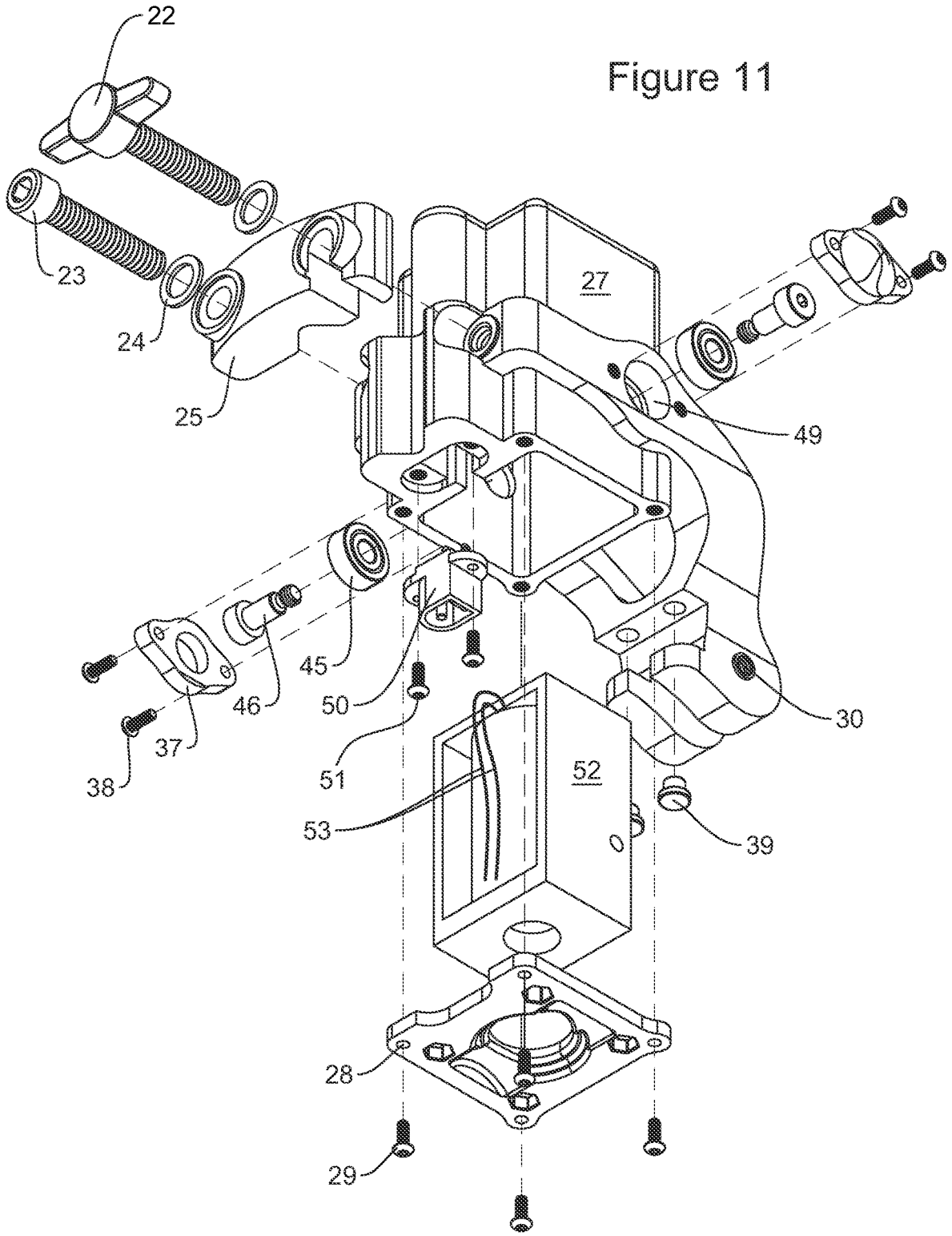
FIG. 11 is a partially exploded view of one actuator shown in FIG. 1.

The preferred embodiment of the actuator 2 (shown in FIGS. 1-2, 5-16) constrains the stroke of the solenoid and the travel of the attached linkage by means of upper bump stops 39 (shown in FIGS. 7-8, 10-11, 13, 15-16), also called stops or bumpers, and lower bump stops 40 (shown in FIGS. 9-10, 13). FIG. 13 presents a sectional view wherein the upper bump stops 39 and the lower bump stops 40 are shown coincidently. The lower bump stops 39 are press-fit, glued, screwed, or otherwise mounted to the mallet assembly body 31 (shown in FIGS. 5-10, 12-17) and they constrain the mallet assembly body 31 and attached mallet arm 35 (shown in FIGS. 5, 7-10, 13-16) and percussion implement 36 (shown in FIGS. 5-6, 8-10, 14, 16) at the condition of maximum solenoid stroke, coinciding with the condition at which the percussion implement 36 is furthest from the drum. The upper bump stops 40 are press-fit, glued, screwed, or otherwise mounted to the actuator body and housing 27 (see FIGS. 5-16) and they constrain the mallet assembly body 31, mallet arm 35, and percussion implement 36 at the condition of minimum solenoid stroke, coinciding with the condition at which the percussion implement 36 is fully actuated and is generally striking or nearly striking the drum.

The upper bump stops 39 (shown in FIGS. 7-8, 10-11, 13, 15-16), and lower bump stops 40 (shown in FIGS. 9-10, 13) of the preferred embodiment of the electromechanical actuator 2 (shown in FIGS. 1-2, 5-16) comprise an elastomeric material. Bump stops comprising elastomeric material can reduce undesirable noise by dampening impact between the mallet assembly body 31 and actuator body and housing 27 and between the solenoid plunger 54 (shown in FIGS. 7-10, 12-13, 15) and solenoid coil and housing 52 (shown in FIGS. 7, 11, 13, 15). The elasticity of elastomeric stops renders them a type of spring, contributing to the bouncing of the mallet assembly body 31 and the attached mallet arm 35 and percussion implement 36 off the stops. Bouncing off the stops is particularly advantageous during a performance of consecutive notes at reduced intervals because it reduces the solenoid's burden to reverse the momentum of the mallet assembly body 31 and attached mallet arm 35 and percussion implement 36. Other embodiments of the electromechanical actuator may comprise other means to constrain the stroke of the solenoid plunger, the travel of the attached mechanical linkage, or both, such as, compression springs, leaf springs, elastomeric bands, adjustable stops, such as screws or rubber-tipped screws, felt cushions, or rigid metal or polymeric stops.

The preferred embodiment of the actuator 2 (shown in FIGS. 1-2, 5-16) employs a pull-type solenoid. An alternative embodiment of the electromechanical actuator may comprise a push-type solenoid. Substitution of the pull-type solenoid comprising the solenoid plunger 54 (shown in FIGS. 7-10, 12-13, 15) and solenoid coil and housing 52 (shown in FIGS. 7, 11, 13, 15) with a push-type solenoid yields inversion of the direction of actuation. Furthermore, according to an embodiment comprising a push-type solenoid, a return spring tending to force the plunger in the direction of the solenoid housing and coil is preferred.

In addition to functioning as a mechanical link between:

a) the rotatable joint about the second axis of rotation 33 (shown in FIG. 5);

b) the rotatable joint about the third axis of rotation 34 (shown in FIG. 5); and c) the clamp comprising the actuator body and housing 27 (shown in FIGS. 5-16), clamp body 25 (shown in FIGS. 5, 7-13, 15-16), clamp wing nut 22 (shown in 5, 7-13, 15-16), clamp screw 23 (5, 9-12, 16), and washers 24 (shown in FIG. 11), for fixing the electromechanical actuator 2 (shown in FIGS. 1-2, 5-16) in place, the actuator body and housing 27 (see FIGS. 5-16) can comprise a feature or features for electrically insulating the user from energized components, or components that may accidentally become energized, such as during a fault. Insulation features described herein are considered optional and preferred. According to the preferred embodiment of the electromechanical actuator 2 (shown in FIGS. 1-2, 5-16), the energized components generally include the solenoid coil, inside the solenoid housing 52 (shown in FIGS. 7, 11, 13, 15), the solenoid leads 53 (shown in FIGS. 7, 11, 15), and the conducting bodies of power input connector 50 (shown in FIGS. 7-13, 15-16). The preferred embodiment of the electromechanical actuator 2 comprises an electrically insulated solenoid coil 52, insulated wiring 53, and an insulated female power input connector 50, therefore, the insulation provided by the actuator body and housing 27 is generally secondary or additional thereto. Similarly, the actuator may be double insulated. Furthermore, the actuator 2 can comprise a thermal cutoff, thermal fuse, or thermal switch to mitigate the risks of solenoid overheating.

The actuator body and housing 27 (shown in FIGS. 5-16), preferably comprises a ventilated enclosure which may, by means of example but not of limitation, be embodied by a filleted rectangular prism. Openings in the enclosure 26 (shown in FIGS. 5, 7, 13, 15) are preferred, to facilitate convection solenoid cooling. Cooling fans, heat sinks, or both, may be employed to cool the solenoid. Where shoulder screws 46 (shown in FIG. 11), are electrically bonded to the solenoid housing 52 (shown in FIGS. 7, 11, 13, 15) insulating caps 37 (shown in FIGS. 5-6, 8-12, 14, 16) can be secured by screws 38 (shown in FIGS. 5-6, 8-12, 14, 16) over the shoulder screws 46 for insulation in the event that the solenoid housing, and the shoulder screws bonded thereto, become accidentally energized.

The description and illustrations herein are not intended to be limiting. Numerous modifications and variations of the invention will be obvious to those skilled in the art and shall be considered within the spirit and scope of the invention. Furthermore, the claims shall not limit the invention to the particular exemplifications presented hereinabove.

The invention claimed is:

1. A system for automatic drumming, comprising:

a MIDI decoder, configured to receive MIDI serial data, decode said MIDI serial data, and output signals according to said MIDI serial data; and at least one actuator configured to hit at least one drum according to the signals outputted by said MIDI decoder;

wherein said at least one actuator comprises:

an electromagnetic solenoid including a plunger, said electromagnetic solenoid and plunger together being rotatable about an axis perpendicular to the direction of travel of said plunger, wherein the axis of rotation of said solenoid and plunger and the axis of rotation of the percussion implement are parallel; and a rotatably mounted percussion implement, rotatably coupled to said plunger.

2. The system of claim 1, wherein said MIDI decoder is further configured for mapping MIDI notes to drums.

3. The system of claim 1, wherein said MIDI decoder is further configured to modify said output signals according to, or by a function comprising, MIDI note velocity.

4. The system of claim 1, wherein said MIDI decoder is further configured to receive said MIDI serial data over USB, 5-pin DIN, or both.

5. The system of claim 1, wherein said MIDI decoder is further a MIDI class-compliant USB device, a USB MIDI Host, or both.

6. The system of claim 1, wherein said MIDI decoder is further configured to enable the user to adjust or control the pulse-width modulation (PWM) duty cycle of said output signals, the duration of said output signals, or both, either for all outputs concurrently, or for a select output or outputs.

7. The system of claim 1, wherein said MIDI decoder is further configured to display MIDI data, PWM settings, or output signal duration, and combinations thereof.

8. The system of claim 1, wherein said at least one actuator further comprises a spring return mechanism configured to reposition the actuator after a drum hit, for a subsequent drum hit.

9. The system of claim 1, wherein said at least one actuator further comprises fixed or adjustable bump stops configured to limit the travel of the drum striking apparatus.

10. The system of claim 1, wherein said at least one actuator further comprises a securement means enabling fast and convenient repositioning of the actuators.

11. The system of claim 1, wherein said at least one actuator further comprises means for fast and convenient substitution of percussion implements.

12. The system of claim 1, wherein said at least one actuator further comprises insulating features, isolating features, or both, configured to mitigate shock hazards.

13. A method for automatic drumming, comprising the steps of:

receiving MIDI serial data;

decoding the MIDI event messages contained in said received MIDI serial data;

generating at least one electrical signal according to said MIDI event data;

routing said at least one signal to at least one drum-striking actuator;

driving at least one percussion implement towards at least one drum by said at least one drum-striking actuator;

striking at least one drum with said at least one percussion implement; and thereby generating at least one percussive noise;

wherein the at least one actuator comprises:

an electromagnetic solenoid including a plunger, said electromagnetic solenoid and plunger together being rotatable about an axis perpendicular to the direction of travel of said plunger, wherein the axis of rotation of said solenoid and plunger and the axis of rotation of the percussion implement are parallel; and a rotatably mounted percussion implement, rotatably coupled to said plunger.

14. The method of claim 13, wherein said at least one electrical signal is generated according to a function comprising said MIDI event data.

15. The method of claim 13, wherein said at least one electrical signal is generated according to a user-selected pulse-width modulation (PWM) duty cycle, a user-selected output signal duration, or both.

16. The method of claim 13, wherein said at least one electrical signal generated is amplified by a power relay.

* * * * *